US007883381B2

(12) United States Patent
Fuzetti et al.

(10) Patent No.: US 7,883,381 B2
(45) Date of Patent: Feb. 8, 2011

(54) ELECTRICAL CABLE CONNECTOR

(75) Inventors: Vagner Fuzetti, Braganca Paulista (BR); Gustavo Oliveira, Serra Negra (BR)

(73) Assignee: Tyco Electronics Brasil LTDA, Sao Paulo (BR)

( * ) Notice: Subject to any disclaimer, the term of this patent is extended or adjusted under 35 U.S.C. 154(b) by 54 days.

(21) Appl. No.: 12/166,358

(22) Filed: Jul. 2, 2008

(65) Prior Publication Data

US 2010/0003864 A1 Jan. 7, 2010

(51) Int. Cl.
*H01R 4/50* (2006.01)

(52) U.S. Cl. ..... 439/783; 439/863

(58) Field of Classification Search ..... 439/783, 439/836, 863, 837
See application file for complete search history.

(56) References Cited

U.S. PATENT DOCUMENTS

| | | | | |
|---|---|---|---|---|
| 1,801,277 | A | 4/1931 | Kelley | |
| 4,650,273 | A | 3/1987 | Roosdrop | |
| 5,006,081 | A * | 4/1991 | Counsel et al. | 439/783 |
| 5,044,996 | A | 9/1991 | Goto | |
| 5,244,422 | A | 9/1993 | Laricchia | |
| 5,281,173 | A | 1/1994 | Cherry et al. | |
| 5,282,761 | A * | 2/1994 | Hollingsworth | 439/790 |
| 5,340,335 | A | 8/1994 | Haun | |
| 5,423,699 | A | 6/1995 | Johnson | |
| 5,507,671 | A | 4/1996 | Chadbourne et al. | |
| 5,538,447 | A | 7/1996 | Chadbourne et al. | |
| 5,567,186 | A | 10/1996 | Diniz et al. | |
| 5,613,883 | A | 3/1997 | Chadbourne et al. | |
| 5,679,031 | A * | 10/1997 | Chadbourne et al. | 439/783 |
| 5,816,865 | A | 10/1998 | Chadbourne | |
| 5,820,422 | A | 10/1998 | Chadbourne et al. | |
| 5,830,019 | A | 11/1998 | Chadbourne et al. | |
| 5,862,589 | A | 1/1999 | Chadbourne et al. | |
| 5,868,588 | A | 2/1999 | Chadbourne et al. | |
| 6,047,464 | A | 4/2000 | Chadbourne et al. | |
| 6,093,065 | A * | 7/2000 | Chadbourne | 439/783 |
| 6,390,861 | B1 | 5/2002 | DeFrance | |
| 7,182,653 | B1 | 2/2007 | Hoxha | |
| 7,309,263 | B2 | 12/2007 | Copper et al. | |
| 7,443,634 | B2 * | 10/2008 | Schreck et al. | 360/135 |
| 2007/0240301 | A1 * | 10/2007 | Johnson et al. | 29/748 |

OTHER PUBLICATIONS

TYCO Electronics, U.D.C.—Universal Distribution Connector Reinforced, Catalog 125003, Mar. 1999, pp. 1-8, AMP Inc., USA.
International Search Report, International Application No. PCT/US2009/003880, International Filing Date Jun. 30, 2009.

* cited by examiner

*Primary Examiner*—Tho D Ta
*Assistant Examiner*—Travis Chambers

(57) ABSTRACT

A wedge connector for mechanically securing two electrical cables and making them electrically common is disclosed. The wedge connector has a C-shaped body member and a wedge. The body member has sides that converge toward a first body member end from a second body member end. The body member has edges that are formed to define a pair of inwardly facing channels connected by a web extending between the channels. The wedge also has converging sides to be conformably received in the C-shaped body member. The wedge has concave, outwardly facing surfaces on each side connected by a web extending between the sides. It also has a spring rib formed in the web that extends continuously from a first wedge end toward a second wedge end.

15 Claims, 4 Drawing Sheets

ELECTRICAL CABLE CONNECTOR

FIELD OF THE INVENTION

The present invention is directed to electrical cable connectors and more particularly to wedge connectors for electrically commoning and mechanically securing two electrical cables, such as those used in electrical distribution networks.

BACKGROUND OF THE INVENTION

In electrical systems it is occasionally necessary to tap into an electrical distribution network, such as connecting an overhead power line to a home or business. One known system for tapping into an electrical distribution network is to use what is commonly referred to as a wedge connector, which includes a C-shaped body member and a wedge. Two cables are electrically commoned and mechanically secured by being pressed into and against interior curved surfaces or channels provided in the C-shaped body member by the wedge, which is driven longitudinally into the body member between the cables.

Sometimes also referred to as Universal Distribution Connectors (or UDC connectors), such wedge connectors are widely used in connecting cables of various sizes (i.e., diameter) for electrical distribution. However, current wedge connectors suffer from the drawback that they are effective over a relatively narrow range of relative cable sizes, requiring many different size wedge connectors.

These and other drawbacks are found in current wedge connectors.

What is needed is a wedge connector that provides for connection of cables over an extended range of relative cable sizes.

SUMMARY OF THE INVENTION

According to an exemplary embodiment of the invention, a wedge connector is disclosed. The wedge connector comprises a C-shaped body member having sides converging toward a first body member end from a second body member end and having edges formed to define a pair of inwardly facing channels along respective sides connected by a web extending between the channels. The connector also comprises a wedge having sides converging toward a first wedge end from a second wedge end to be conformably received in the C-shaped body member. The wedge has concave, outwardly facing surfaces on each side connected by a web extending between the sides and a spring rib formed in the wedge web. The spring rib extends continuously from the first wedge end toward the second wedge end opposite the first wedge end. The wedge, when conformably received in the C-shaped body member is positioned to mechanically secure a cable between the inwardly facing channel of the C-shaped body member and the concave outerwardly facing surface of the wedge.

According to another exemplary embodiment of the invention, a wedge connector includes a C-shaped body member having sides converging toward a first body member end from a second body member end and having edges formed to define a pair of inwardly facing channels along respective sides connected by a web extending between the channels. The channels have extensions that diverge rearwardly away from the second body member end. The connector further includes a wedge having sides converging toward a first wedge end from a second wedge end to be conformably received in the C-shaped body member. The wedge has concave, outwardly facing surfaces on each side connected by a web extending between the sides, the wedge further having a single spring rib formed in the wedge web, the spring rib extending continuously from the first wedge end toward the second wedge end. The wedge, when conformably received in the C-shaped body member, is positioned to mechanically secure a cable between the inwardly facing channel of the C-shaped body member and the concave outwardly facing surface of the wedge.

In some embodiments, one or more of the cable receiving surfaces of the connector are coated with a dry film lubricant.

An advantage of certain exemplary embodiments described herein is that a single wedge connector can be used across a greater variety of cable diameters than is currently available.

Another advantage is that the ability to expand the range of cables is achieved without the need to substantially increase the thickness of the connector components, and thus without increasing material costs.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Figure 1:
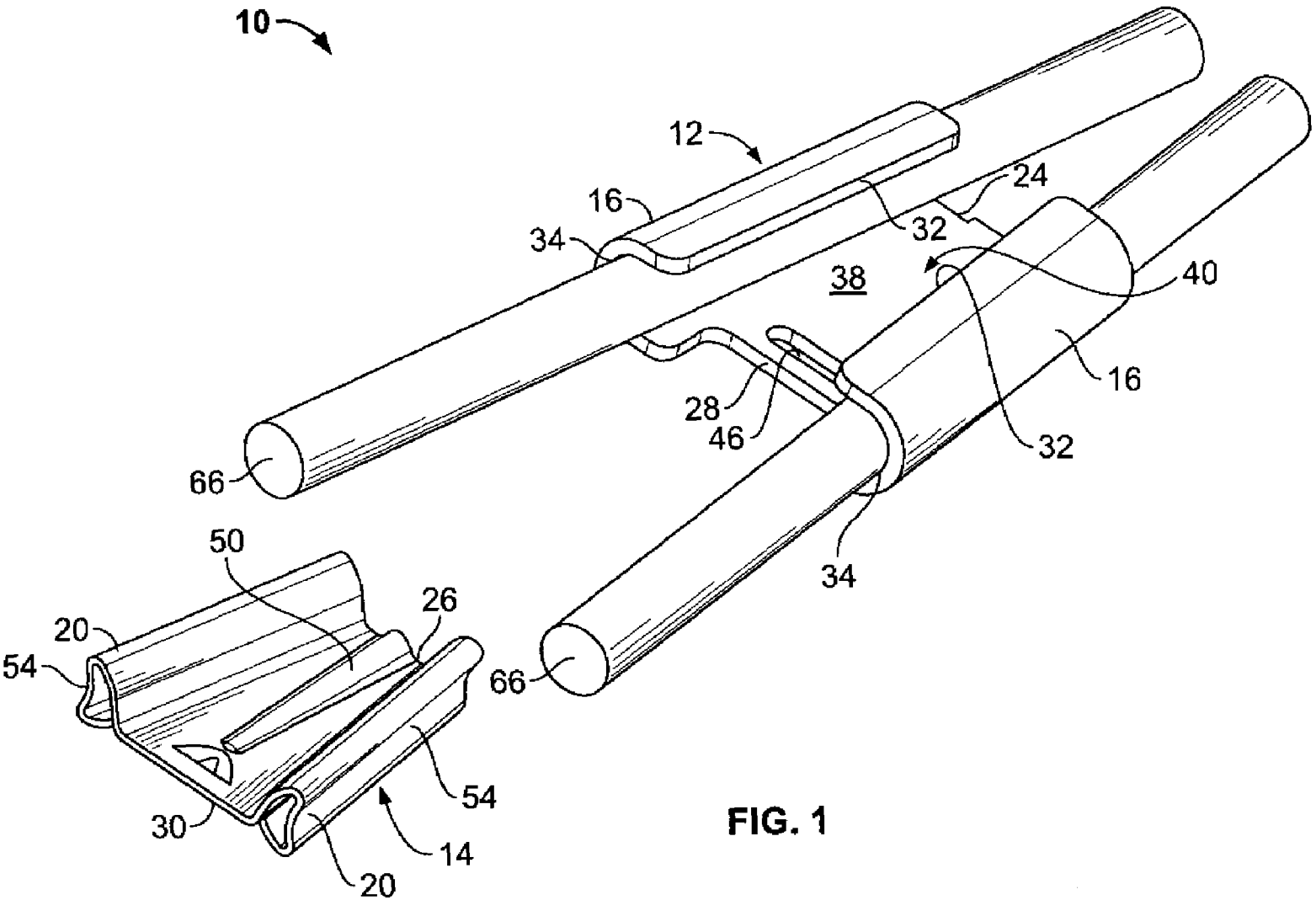
FIGS. 1 and 2 are perspective views of a wedge connector in accordance with an exemplary embodiment of the invention.
Figure 2:
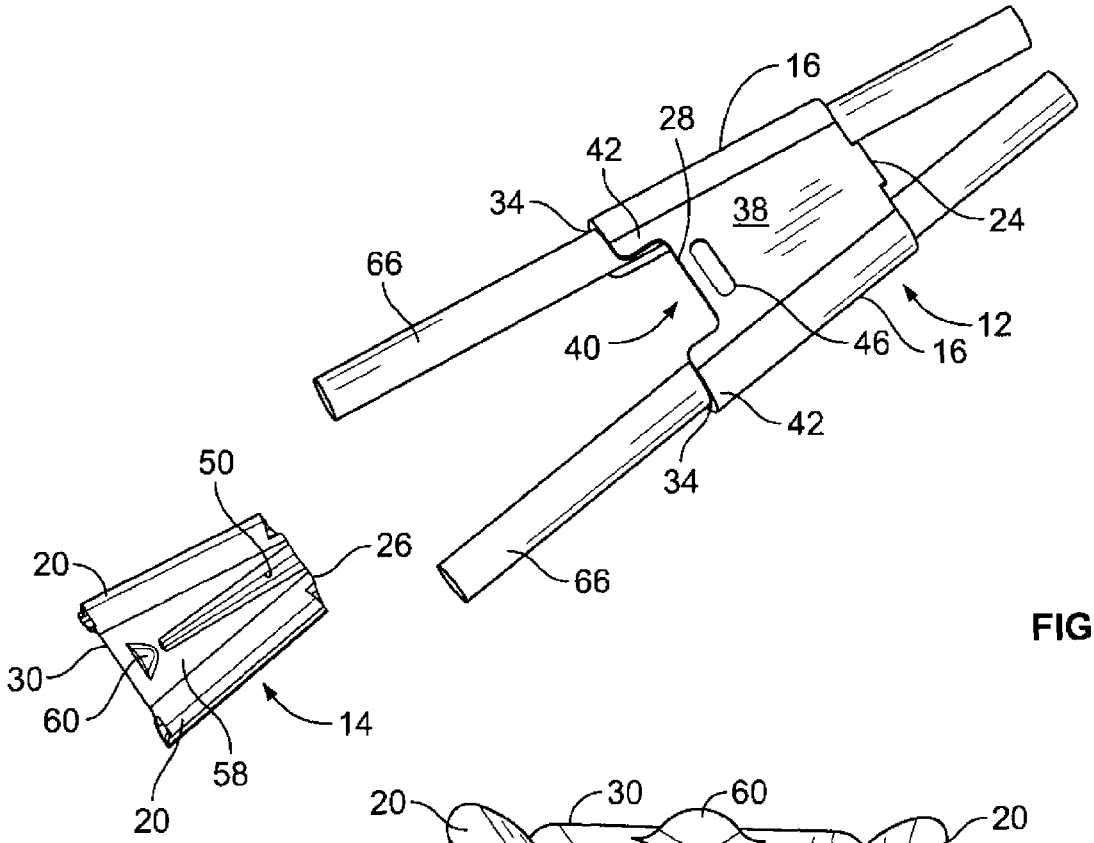

As shown in FIGS. 1 and 2, a wedge connector 10 includes a C-shaped body member 12 and a wedge 14. Both components 12, 14 have a wedge geometry. Opposing sides 16 of the C-shaped body member 12 converge toward a first body member end 24 from a second body member end 28. Likewise, opposing tubular edge members 20 of the wedge 14 converge toward a first wedge end 26 from a second wedge end 30.

The body member 12 and wedge member 14 may be constructed from any electrically conductive material such that a pair of cables secured together with the wedge connector 10 are electrically common. In one embodiment, each of the body and wedge members 12, 14 are formed of tin-plated copper alloy. The body and wedge members 12, 14 can be produced by stamping and forming.

Edges 32 of the C-shaped body member 12 are rolled in or otherwise configured to form inwardly facing channels 34 that are joined by a body member web 38 extending between them. The channels 34 and body member web 38 together define a space 40 for receiving the wedge 14. In the embodiment illustrated, the channels 34 are of equal size, but could be of unequal size. In another embodiment, as shown in FIG.

6, the body member 12 may include a plurality of teeth 48 spaced longitudinally along each of the channels 34. The teeth 48 extend inwardly into the space 40 and can be used to provide additional grip that has the effect of increasing the tensile strength of the connector 10, which can further prevent the cables 66 from being pulled out when in use.

Figure 3:
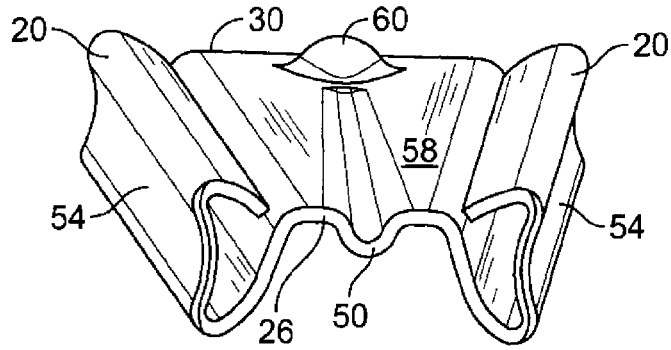
FIG. 3 is a perspective view of the wedge of the wedge connector of FIGS. 1 and 2.

As better seen with reference to FIG. 3, the wedge 14 includes the pair of tubular edge members 20, each edge member 20 having an outwardly facing concave surface 54. As illustrated, the edge members 20 may be chamfered near the first wedge end 26, which may assist during connector assembly. A wedge web 58 extends between and joins the tubular edge members 20. The wedge 14 may include an arcuate shaped feature 60 that may be blanked out of the wedge web 58 and can be used as a locking mechanism in conjunction with a receptacle, such as an aperture 46, formed in the body member web 38 (FIG. 2).

The wedge 14 further includes a spring rib 50 formed in the wedge web 58 that generally extends in a longitudinal direction from the first wedge end 26 toward the second wedge end 30. The spring rib 50 protrudes from the web surface so as to be positioned within the space 40 defined by the body member 12 when the wedge 14 is conformably received in the body member 12 of the connector 10. The spring rib 50 is continuous along its length, although its dimensions may vary over that length. Preferably, the spring rib 50 is tapered such that the width of the spring rib 50 gradually decreases as the distance from the first wedge end 26 increases, as illustrated. That is, while the tubular members 20 of the wedge 14 converge toward the first wedge end 26 from the second wedge end 30, the spring rib 50 conversely converges toward the second wedge end 30 from the first wedge end 26.

The spring rib 50 extends toward, but generally does not extend to, the second wedge end 30. The spring rib 50 ordinarily extends at least one half the length of the wedge web 58. Where the wedge 14 contains a feature 60 at or near the second end of the wedge 14, the spring rib 50 may extend to the feature 60, which ordinarily projects from a surface of the wedge web 58 opposite that of the rib 50.

The use of a single spring rib 50 in this manner provides an advantage in that the spring rib 50 provides sufficient resilience to resist deformation of the wedge 14 and thus provide sufficient retention force when the connector 10 is used with smaller diameter cables. Conversely, the spring rib 50 still provides sufficient strength when flexed to accept larger cables without increasing the size or thickness of the connector components. The spring rib 50 also helps prevent rolling and/or buckling of the wedge side members 20. The wedge 14 may include multiple spring ribs.

Cables 66 are secured in the connector 10 by driving the wedge 14 into the C-shaped body member 12 between the cables 66, which are compressed between the channels 34 of the body member 12 and the outwardly facing surfaces 54 of the wedge 14. Securing can ordinarily be accomplished, for example, with a pair of adjustable pliers. The conductive nature of the connector 10 has the combined effect of both securing the two cables 66 and making them electrically common.

In one embodiment, the cable-contacting surfaces of either one or both of the body member 12 and wedge 14 can be coated with a dry film lubricant to aid the user with insertion of the wedge 14 into the body member 12. Any known dry film lubricant, such as graphite, for example, can be used. Preferably, at least the wedge's concave outwardly facing surfaces 54 are coated with the dry film lubricant.

Figure 4:
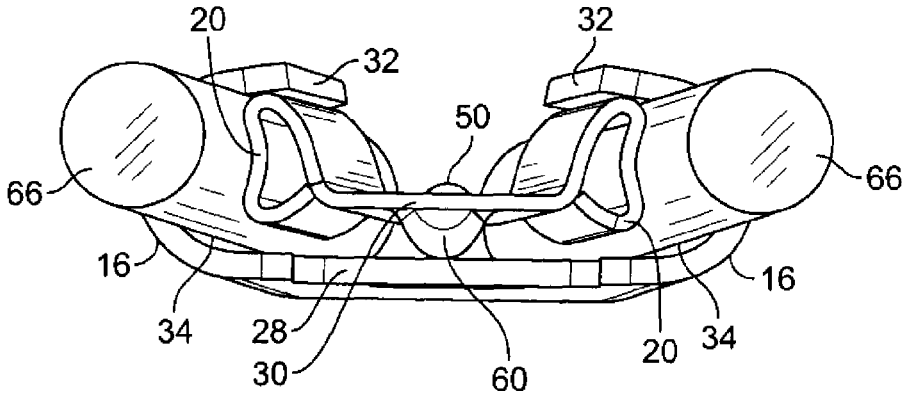
FIG. 4 is a rear end view of the wedge connector of FIGS. 1 and 2 with a pair of cables secured therein.

As the wedge 14 is being pressed into space 40, the sides 16 of the C-shaped body member 12 are resiliently forced outwardly to provide a continuing compressive force on the cables 66. An equal counterforce is applied against the outwardly facing surfaces 54 of the wedge's tubular edge members 20, some of which is alleviated by compression of the spring rib 50, which distributes the force throughout the wedge web 58.

Where a locking mechanism is employed, such as the illustrated feature 60 and aperture 46 combination, the two components of the locking mechanism can be positioned such that the wedge 14 has reached the correct insertion depth when the feature 60 enters the aperture 46. The wedge web 58 deflects slightly as feature 60 slides over the body member web 38 of the C-shaped body member 12 and rebounds to drive the feature 60 into the aperture 46 sharply. FIG. 4 illustrates a rear view of a fully assembled version of the connector 10 immediately prior to the feature 60 rebounding into the aperture 46.

As shown, the wedge 14 is symmetric and the outwardly facing concave surfaces 54 on the edge members 20 are formed so that each can accommodate a cable of identical gauge. Alternatively, the wedge 14 could be formed asymmetrically, having tubular edge members 20 and corresponding surfaces of different size to accommodate a cable on one surface of a diameter different than that of the other surface.

As best seen in FIG. 2, exemplary embodiments further achieve an extended range of cable sizes that can be used with a single connector 10 by providing extensions 42 to the body member channels 34 that extend rearwardly away from the second body member end 28 of the C-shaped body member 12. That is, the C-shaped body member 12 may be formed so that the channels 34 are longer than the body member web 38.

Figure 5A:
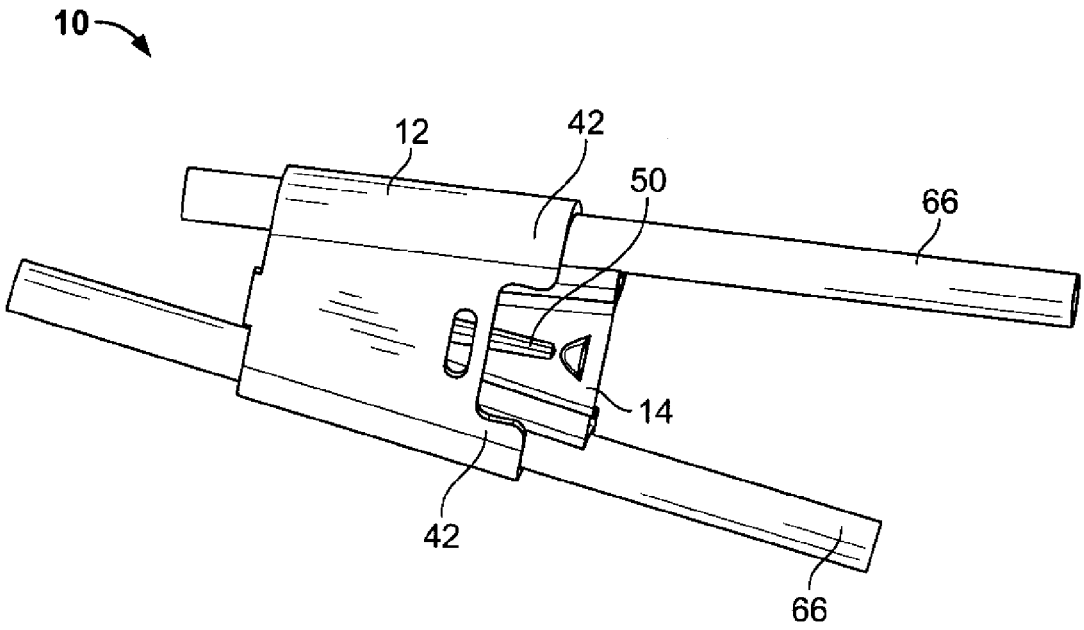
FIGS. 5*a* and 5*b* are perspective views of a wedge connector having a pair of cables secured therein illustrating the ability to accommodate a large range of cable diameters.
Figure 5B:
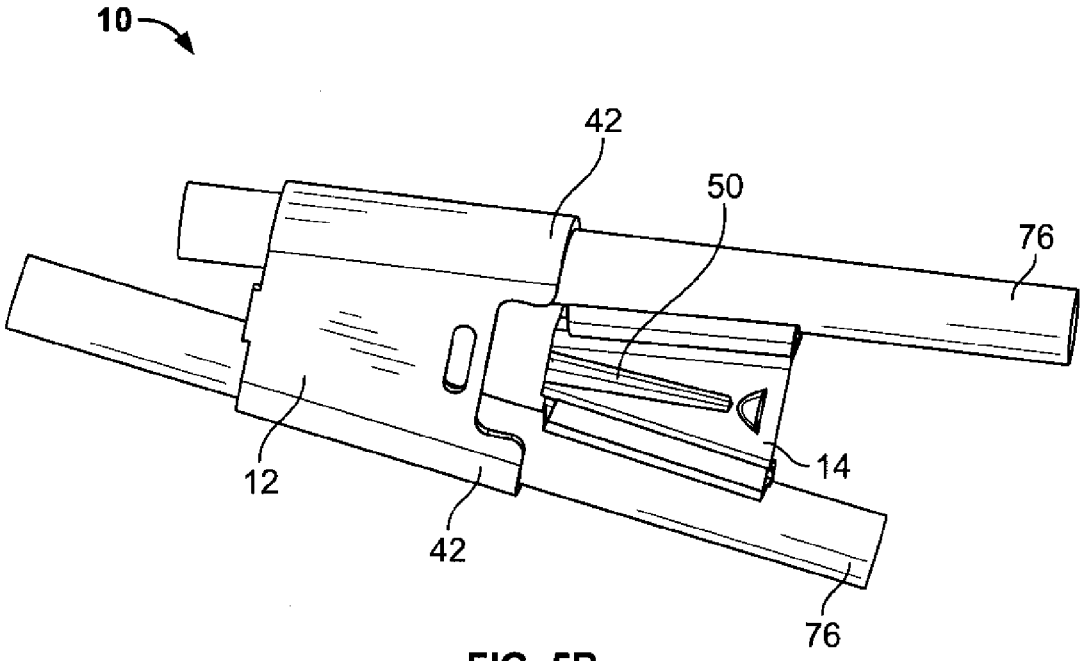
Figure 6:
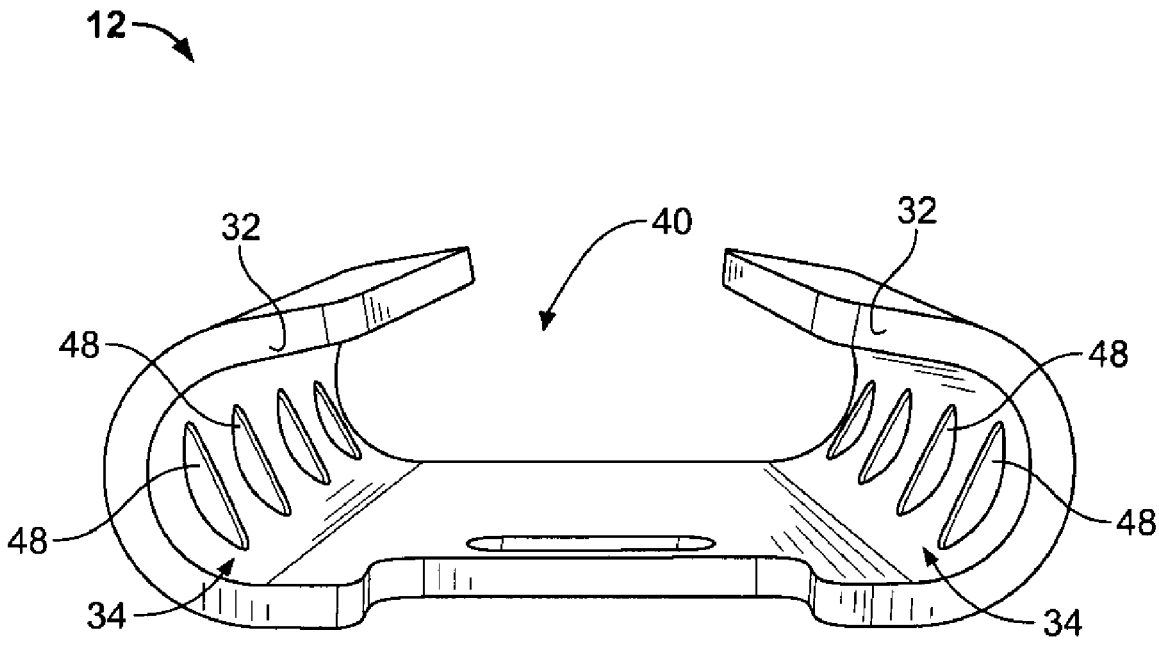
FIG. 6 is a perspective view of the C-shaped body member in accordance with an exemplary embodiment.

Turning to FIGS. 5*a* and 5*b*, the extensions 42 further assist in permitting the same connector 10 to be used to join cables across a range of sizes from a minimum diameter (5*a*) to a maximum diameter (5*b*). The body member channel extensions 42 provide a particular advantage when, as shown in FIG. 5*b*, cables 76 of a diameter at the upper range of the connector's capability are used, because the wedge 14 is initially positioned a greater distance away from the body member 12 prior to driving the wedge 14 into the body member 12 due to the presence of the larger diameter cables. The extensions 42 provide additional support in keeping the cables 76 properly positioned until the wedge 14 is fully inserted.

In one embodiment, the connector 10 can be used for connecting two cables having a diameter in the range of about 16 mm to about 21 mm. Alternatively stated, a single connector 10 in accordance with an exemplary embodiment having a single spring rib 50 and channel extensions 42 can replace the three separate connectors currently needed for this cable range (e.g., UDC connector Types VI, VII, and VIII). This range is by way of example only and it will be appreciated that other ranges of cable diameters may be accommodated with other embodiments.

The angles at which the body member 12 and wedge 14 converge may be the same or different. In one embodiment, each side 16 of the body member 12 has an angle of about 5.5 degrees, each of the side members 20 of the wedge 14 has an angle of about 7 degrees. As a result, the wedge 14 converges slightly more sharply than the body member 12, which can provide for better performance in helping the wedge travel from the initial to the locked position when the connector 10 is used with larger diameter cables.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A wedge connector comprising:

a C-shaped body member having sides converging toward a first body member end from a second body member end and having edges formed to define a pair of inwardly facing channels along respective sides connected by a web extending between the channels, the C-shaped body member's inwardly facing channels including extensions that extend rearwardly away from the body member web; and a wedge having sides converging toward a first wedge end from a second wedge end to be conformably received in the C-shaped body member, the wedge having concave, outwardly facing surfaces on each side connected by a web extending between the sides, the wedge further having a spring rib formed in the wedge web, the spring rib extending continuously from the first wedge end toward the second wedge end opposite the first wedge end, wherein the spring rib has a width that decreases as the distance from the first wedge end increases, the spring rib converging in a direction opposite that of the converging sides of the wedge and wherein the spring rib extends continuously from the first wedge end toward the second wedge end a distance greater than one half the length of the wedge, wherein the wedge, when conformably received in the C-shaped body member, is positioned to mechanically secure a cable between the inwardly facing channel of the C-shaped body member and the concave outerwardly facing surface of the wedge.

2. The wedge connector of claim 1, wherein the wedge member includes a single spring rib.

3. The wedge connector of claim 1, wherein the rib extends continuously from the first wedge end toward the second wedge end to a feature extending outwardly away from the wedge web toward the body member web.

4. The wedge connector of claim 1, wherein the C-shaped body member wedge includes a receptacle to receive a feature extending outwardly away from the wedge web.

5. The wedge connector of claim 1, wherein the C-shaped body member's inwardly facing channels are of a length greater than that of the body member web.

6. The wedge connector of claim 1, wherein a surface of the C-shaped body member's inwardly facing channels are coated with a dry film lubricant.

7. The wedge connector of claim 1, wherein the concave, outwardly facing wedge side edge surfaces are coated with a dry film lubricant.

8. A wedge connector comprising:

a C-shaped body member having sides converging toward a first body member end from a second body member end and having rolled over edges formed to define a pair of inwardly facing channels along respective sides connected by a web extending between the channels, the channels having extensions diverging rearwardly away from the second body member end; and a wedge having sides converging toward a first wedge end from a second wedge end to be conformably received in the C-shaped body member, the wedge having concave, outwardly facing surfaces on each side connected by a web extending between the sides, the wedge further having a single spring rib formed in the wedge web, the spring rib extending continuously from the first wedge end toward the second wedge end, wherein the single spring rib has a width that decreases as the distance from the first wedge end increases, the spring rib converging in a direction opposite that of the converging sides of the wedge, wherein the spring rib extends continuously from the first wedge end toward the second wedge end a distance greater than one half the length of the wedge, wherein the wedge, when conformably received in the C-shaped body member, is positioned to mechanically secure a cable between the inwardly facing channel of the C-shaped body member and the concave outerwardly facing surface of the wedge.

9. The wedge connector of claim 8, wherein the wedge is conformably received in the C-shaped body member to mechanically secure a cable having any diameter in the range of about 16 mm to about 21 mm.

10. The wedge connector of claim 8, wherein the wedge is conformably received in the C-shaped body member to mechanically secure and make electrically common two cables of the same diameter.

11. The wedge connector of claim 8, wherein the C-shaped body member has an inwardly facing channel surface coated with a dry film lubricant.

12. The wedge connector of claim 8, wherein the concave, outwardly facing side edge wedge surfaces are coated with a dry film lubricant.

13. The wedge connector of claim 8, wherein the sides of the wedge converge at an angle greater than an angle at which the sides of the C-shaped body member converge.

14. The wedge connector of claim 8, further comprising a plurality of teeth longitudinally spaced along the inwardly facing body-member channels.

15. The wedge connector of claim 8, wherein the sides of the wedge are chamfered.

* * * * *